US006200020B1

(12) United States Patent
Rieben

(10) Patent No.: US 6,200,020 B1
(45) Date of Patent: Mar. 13, 2001

(54) OPERATING MEANS WITH A SEAL, FOR A TIMEPIECE

(75) Inventor: Hans Rieben, Bettlach (CH)

(73) Assignee: Meco SA Grenchen, Grenchen (CH)

( * ) Notice: Subject to any disclaimer, the term of this patent is extended or adjusted under 35 U.S.C. 154(b) by 0 days.

(21) Appl. No.: 09/090,978

(22) Filed: Jun. 5, 1998

(30) Foreign Application Priority Data

Jun. 11, 1997 (CH) ..... 1419/97

(51) Int. Cl.[7] ..... G04B 37/00; G04B 29/00
(52) U.S. Cl. ..... 368/290; 368/319
(58) Field of Search ..... 368/288–290, 368/319–321

(56) References Cited

U.S. PATENT DOCUMENTS

| | | | | |
|---|---|---|---|---|
| 2,773,347 | * | 12/1956 | Froidevaux | 368/288 |
| 3,130,539 | * | 4/1964 | Davis | 368/289 |
| 3,164,954 | * | 1/1965 | Soguel | 368/288 |
| 3,376,701 | * | 4/1968 | Grohoski et al. | 368/289 |
| 3,475,901 | * | 11/1969 | Soguel | 368/289 |
| 3,485,036 | * | 12/1969 | Feurer | 368/289 |

FOREIGN PATENT DOCUMENTS

| | | |
|---|---|---|
| 237996 | 9/1945 | (CH) . |
| 296726 | 5/1954 | (CH) . |
| 304789 | 4/1955 | (CH) . |
| 316836 | 12/1956 | (CH) . |
| 324259 | 10/1957 | (CH) . |
| 346176 | 6/1960 | (CH) . |
| 453221 | 6/1968 | (CH) . |
| 562 468 | 5/1975 | (CH) . |
| 468 663 | 3/1969 | (DE) . |
| 2 344 882 | 10/1977 | (FR) . |

* cited by examiner

*Primary Examiner*—Vit Miska
(74) *Attorney, Agent, or Firm*—Griffin & Szipl, P.C.

(57) ABSTRACT

An operating means such as for example a crown, with an element rigid with the housing and with an operable element which is movable with respect to this. Between these two elements there is arranged a lip seal with an elastic lip, which bears on the element rigid with the housing and delimits the timepiece inner space to the surroundings. By way of the fact that the lip is led in the direction of the surroundings conically onto the element rigid with the housing and lies on this element with pretensioning, on the one hand with an inner space excess pressure it may release itself from the element rigid with the housing for the purpose of pressure compensation between the inner space and the surroundings and on the other hand with a surrounding excess pressure it is more strongly pressed on the element rigid with the housing for the purpose of sealing the inner space with respect to the surroundings.

16 Claims, 3 Drawing Sheets

OPERATING MEANS WITH A SEAL, FOR A TIMEPIECE

BACKGROUND OF THE INVENTION

The present invention relates to an operating means with a seal, for a timepiece, according to the introductory part of claim 1. For sealing operating organs of a timepiece usually O-rings are applied. Since these do not always seal the inside of the timepiece to a satisfactory degree, already for some time there has been undertaken a variety of efforts to develop seals with improved sealing properties, in that the cross sectional shape of the O-rings has been dropped.

From CH 562 468 a dust-tight crown for timepiecees is known, which comprises an elastically deformable sealing packing with an S-shaped bent cross sectional shape. Although this sealing packing in comparison to O-rings on the side of the inner space is formed out differently than on the side which faces the surroundings, this packing acts roughly equally in both directions, i.e. that on excess pressure in the timepiece inner space it has a similar sealing behaviour as with a excess pressure in the surroundings.

On the one hand a packing of such a shaping ensures that a formation of a considerable excess pressure in the inside of the timepiece cannot occur since it comprises a tapering packing part which in such a situation comes away from the wall of the bore.

If however the pressure of the surroundings of a timepiece equipped with such a crown increases, for example on diving, then this packing likewise only puts up a small resistance to the penetration of matter into the inside of the timepiece on account of the shaping of the mentioned packing part.

Furthermore this solution has the disadvantage that on placing back the winding axis, from the hand setting position into the basic position, particles of dirt from the tapering packing part may be co-transported into the inside of the timepiece. By way of the contamination of the sealing region the danger of penetration of water is also considerably larger.

Furthermore such a crown requires an exact length setting and assembly of the winding-up shaft.

With CH 453 221 there is shown an operating organ with an L-shaped seal which comprises a conical sealing surface which is in contact with the outer walling of a sleeve arranged in the timepiece housing. This sleeve is formed conically so that the placing of the crown onto the sleeve can be carried out simply. In the placed-on condition the sealing is deformed so far that the conical sealing surface blends into a cylindrical one and accordingly bears on the sleeve over the whole circumference with a close fit, and with a relatively large pretensioning. For the purpose of an additional increasing of the bearing force the sealing is designed in a manner such that it broadens towards the inside in the direction to the axis.

As a rule the solution implies a differing sealing behaviour in both directions, however it has the effect that it only prevents penetration of matter into the inside of the timepiece in a limited manner and that a rapid reduction of excess pressure in the timepiece is not possible.

According to CH 324 259 between a bore in the crown and the outer walling of the sleeve there is arranged a sealing ring with a V-shaped cross section in whose wedge-shaped annular groove there is arranged a metal ring which is axially impinged by a spring. By way of the spring pressure the two arms of the V-shaped sealing ring are radially expanded in order to produce a bearing force on the one hand with respect to the sleeve and on the other hand to the bore of the crown.

Also with this solution there may arise a considerable excess pressure on the inside of the timepiece.

Furthermore CH 304 789 shows sealing disks which in each case bear on an annulus-shaped surface in a deformed manner and under pretension.

Although with this solution a reduction in excess pressure in the timepiece is possible, narrow limits are set to the axial path of the winding-up shaft.

Moreover also an exact length setting of the winding-up shaft is required.

BRIEF SUMMARY OF THE INVENTION

It is therefore an object of the present invention to provide an operating means which

- given surrounding excess pressure excellently seals,
- given surrounding negative pressure permits a rapid pressure compensation,
- does not require an exact length setting and assembly of the shaft,
- permits a sufficiently large movement path of the shaft,
- as well as keeping away dirt particles from the sealing region and from the inside of the timepiece.

The solution according to the invention is to be deduced from the features of claim 1.

By way of the fact that the operating means according to the invention is provided with a lip seal which is orientated such that the concentric skirting-shaped lip faces from the inner space of the timepiece to the surroundings, the lip with an increasing excess pressure of the surroundings is pressed more heavily on the cylinder jacket shaped surface region, from which there arises an excellent sealing.

In reverse, with a negative pressure the lip is advantageously so deformed in the timepiece that it is pressed away from the cylinder jacket shaped surface region and forms a passage for a rapid reduction of pressure.

The lip sealing thus acts without additional displaceable elements as an automatically actuating valve.

Furthermore a lip sealing in the suggested alignment has the advantage that it acts as a dirt stripper and thus prevents access of dirt particles to the sealing region as well as to the inside of the timepiece. By way of this the sealing region remains constantly clean and the danger of entry of water is considerably reduced. For example and additionally provided O-ring likewise remains clean in this manner and its quality of sealing, in particular with respect to water, remains.

Sealing region is to be understood as contact surfaces of the seal as well as of the parts of the operating means in contact with this or with the timepiece, i.e. surface regions of the seal as well as surface regions of for example the outer or inner wallings of the sleeve, of the cover of the timepiece housing etc., according to the embodiment form of the operating means according to the invention.

In contrast to an O-ring, with the lip seal there is still a further advantage of great importance: O-rings on account of their manufacture comprise a circular seam which is located at the location of the largest circumferential line. With seals of small dimensions, this seam, as is the case in the field of timepiecees, is characterized by prominent irregularities of the surface, which considerably compromise their sealing qualities. With a lip seal on the other hand at the sealing locations, i.e. in those regions which are in contact with the walling of the bore there are no seams present. Also this contributes considerably to the improvement of the tightness.

The operating means according to the invention further comprises the advantage that by way of the application of a lip seal no exact length setting and assembly of a possibly provided shaft is required and without problem a larger path of this shaft may be provided for. With this it may be the case of a hand-setting or winding-up shaft or likewise.

According to a further advantageous formation according to the invention a screwed crown comprises a further O-ring which is compressed on screwing on the cover, this resulting in the advantage of a further sealing security in the case of an increase in external pressure as occurs for example on diving. The sealing properties of the lip seal of the operating means according to the invention are however superb in the manner that on diving there neither enters any water when the cover is not screwed down.

The operating means according to the invention may for example be a screwed or non-screwed crown, a pushpiece, a correcter, a switch or likewise.

BRIEF DESCRIPTION OF THE DRAWINGS

One embodiment example of the invention is described in more detail by way of drawings. There are shown in the FIGS. 1*a*, 1*b* and 1*c* an embodiment form of the operating means according to the invention in the form of a screwed crown 10, in an axial section, in each case in various positions of the crown cover.

DETAILED DESCRIPTION OF THE INVENTION

Figure 1A:
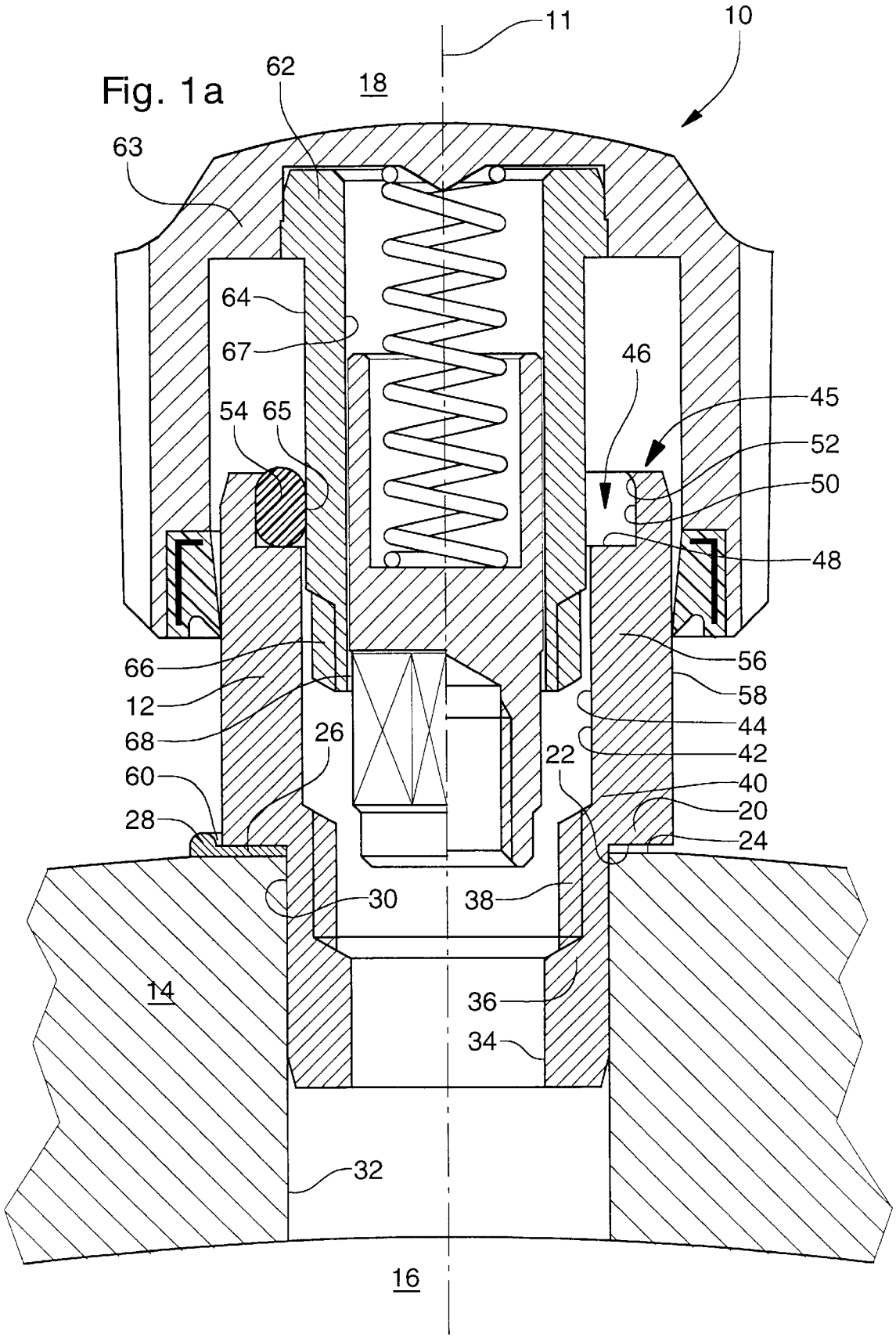

There follows a description of the inventive screwed crown 10. For the three FIGS. 1*a*, 1*b* and 1*c* for all shown parts the same reference numerals apply, wherein the inclusion of these reference numerals is distributed over the three FIGS. 1*a* to 1*c* for the purpose of clarity.

The screwed crown which is essentially rotationally symmetrical with respect to the axis 11 according to FIG. 1*a* comprises a continuous hollow sleeve 12 which is pressed in a middle part shown only partly or in a housing 14 of a timepiece. In the timepiece there is defined an inner space 16 lying below in the drawing, which is hermetically sealed from the surroundings 18 shown above in the drawing.

The sleeve 12 comprises a shoulder 20 which faces outwards with respect to the axis 11, with a bearing surface 22 which is annulus-shaped with respect to the axis 11 and which faces the housing 14. Between this bearing surface 22 and a bearing surface 24 of the housing 14 corresponding to this there is arranged a sealing disk 26 which at its outer peripheral region comprises a thickening or an annular bulge 28 which extends leading away from the housing 14 and gives the sealing disk 26 an approximate L-shaped cross section.

The sealing disk 26 is exceptionally shown in FIG. 1*a* only left of the axis 11 in order, on the right side, to permit a clear description of the bearing surfaces 22 and 24.

For pressing in the sleeve 12, or rather the operating organ 10 into the housing 14, the sleeve 12 comprises a cylinder jacket shaped shank 30 which is arranged with an interference fit in a bore 32 leading through the housing 14.

On the inside the hollow sleeve 12 is stepped several times and comprises a bore 34 on the one side proximal to the housing 14. To this bore 34 in the direction away from the housing 14 there is connected a shoulder 36 which faces radially outwards with respect to the axis 11, from which an inner thread 38 leads up to a further shoulder 40. Connected to this shoulder 40 which again leads radially outwards from the inner thread 38, there extends an bore 42 with a cylinder jacket shaped walling 44 further in the direction away from the housing 14. Finally the sleeve 12 comprises a groove 46 on the side 45 distant to the housing 14. This groove 46 is formed by an annulus-shaped bearing surface 48 bordering on the bore 42, a cylinder jacket shaped bearing surface 50 proceeding from this annulus-shaped bearing surface as well as a bearing surface 52 running or tapering conically to the axis 11. In the groove 46 there is arranged an O-ring 54 wherein this is only shown left of the axis 11 in order on the right side to permit a clear illustration of the groove 46 and the bearing surfaces 48, 50 and 52.

The bore 42 is arranged in the region of a shank 56 of the sleeve 12, this shank projecting out of the housing 14. Externally this shank 56 comprises a cylinder jacket shaped surface 58 and in the region of the upper end 45 of the sleeve runs out conically to the axis 11. Between the surface 58 of the shank 56 and the bulge 28 of the sealing disk 26 there is provided a small relief 60 in the shape of an approximately wedge-shaped annular groove.

In the sleeve 12 there is arranged a small tube 62 which is axially movable with respect to the sleeve and which is fixed in a cover 63 illustrated above. The small tube 62 comprises externally a cylinder jacket shaped surface 64 on which there bears with pretensioning, with its inner side 65, the O-ring 54 accommodated in the groove 46. On the lower side of the small tube 62 the surface 64 blends into an outer thread 66 which fits together with the inner thread 38. In the inside the small tube 62 comprises an almost completely continuous bore 67 which shortly before its lower end blends into a short hexagon socket 68 which cannot be deduced from the figures.

Figure 1B:
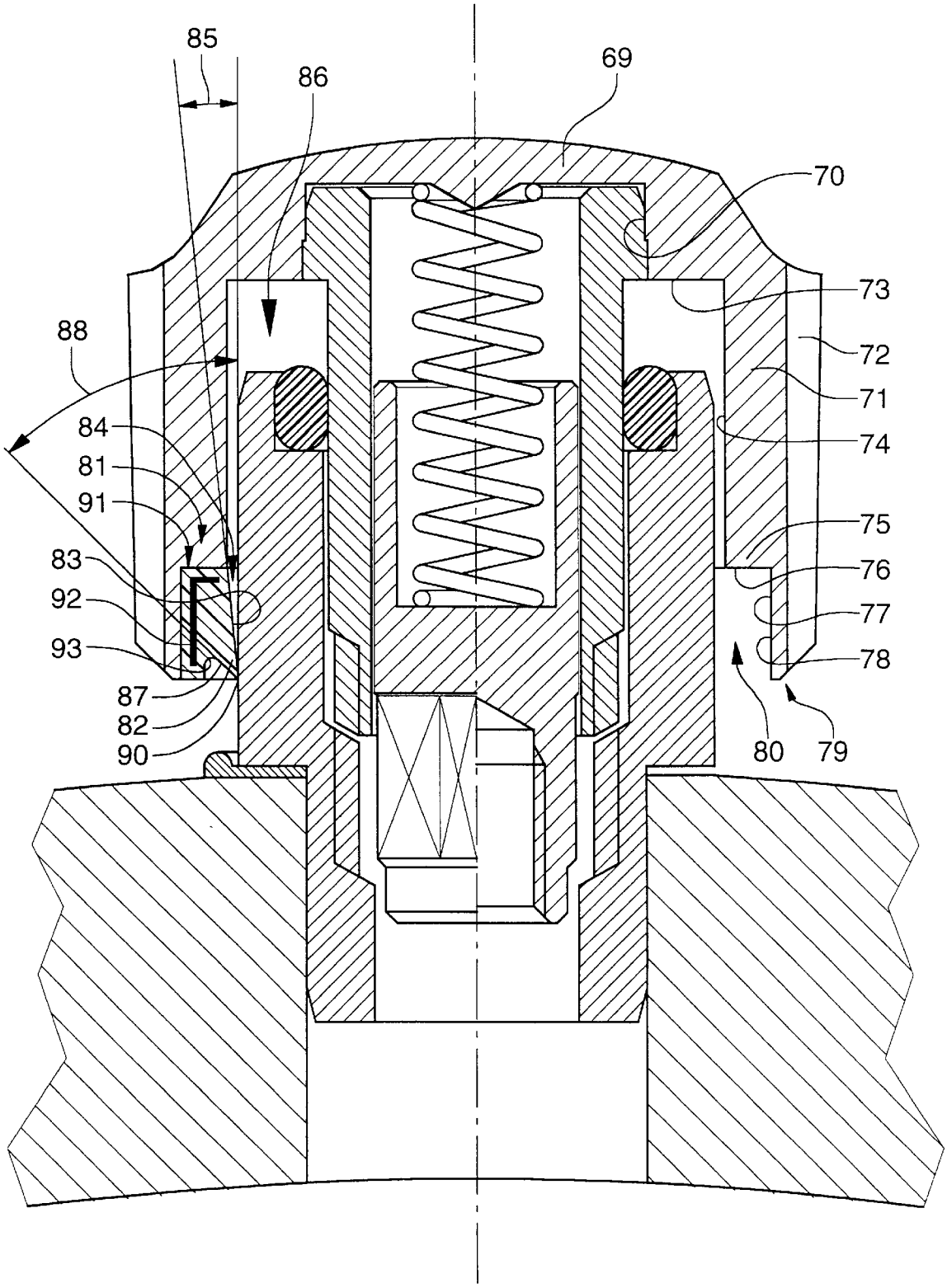

The following reference numerals are incorporated into FIG. 1*b*.

The cover 63 comprises a head 69 in which the small tube 62 is pressed into a short pocket hole 70, and a hollow cylinder shaped skirting 71 which for the purpose of a better gripping when screwing down and unscrewing the lid 63, is provided with a longitudinal knurling 72 on the outer side. In the region between the head 69 and the skirting 71 internally in the cover 63 there is provided an annulus-shaped bearing surface 73 for the O-ring 54, which is partly formed also by the small tube 62. On the inside the skirting 71 comprises a bore 74 which proceeds from the head 69 and is led along in the direction of the housing 14 up to a step 75. This step 75 comprises an annulus-shaped bearing surface 76 facing radially outwards with respect to the axis 11 and forms a transition to a short bore 77 whose diameter exceeds that of the bore 74. The short bore 77 comprises a cylinder jacket shaped walling or bearing surface 78 which reaches up to the lower, i.e. the end 79 of the skirting 71 facing the housing 14.

Thus the bore 77 with the step 75 forms an inner annular groove open on one side or an annular free space 80 in which a lip seal 81 is arranged. This lip seal 81 is exceptionally in FIG. 1*b* not shown right of the axis 11 in order permit a clear illustration of the free space 80, the bore 77 as well as the bearing surfaces 76 and 78.

The lip seal 81 comprises a rotationally symmetric elastic lip 82 which tapers in the direction towards the housing and to the axis 11 and which leads conically up to the cylinder jacket-shaped surface 58 as well as bearing on this with pretensioning. The rotationally symmetrical lip 82 or skirt is in other words designed and so orientated with respect to the axis 11 that its inner dimension or its inner diameter reduces in the direction towards the housing 14 and essentially forms the surface of a envelope of a truncated cone. Between this surface which is called the first surface region 83 and the surface 58 of the sleeve 12 a rotationally symmetric free space 84 with an essentially wedge-shaped cross section and an acute angle 85 of for example 10° is formed.

The inner space 16 shown below in FIG. 1*a* leads up to the O-ring 54. Between the O-ring 54, the lip 82, the sleeve 12 and the cover 63 there is enclosed an intermediate region 86. With regard to the function of the lip seal 81 this intermediate space 86 can be regarded as belonging to the inner space 16.

Additionally to the first surface area region 83 the lip seal 81 comprises a second rotationally symmetric surface region 87. This second surface region 87 likewise approaches the surface 58 of the sleeve 12 continuously in the direction to the housing 14 and to the axis 11 and forms essentially the surface of an envelope of a truncated cone. Both surface regions 83 and 87 accordingly face in a similar direction, i.e. in the direction to the housing 14 and the axis 11. Between the second surface region 87 and the surface 58 of the sleeve 12 there is present an angle 88 which is smaller than 90°, i.e. is for example 45°. As a result the lip 82 is formed annular wedge shaped with an angle of for example 35° and comprises in the contact region with the surface 58 an approximately pointed edge region 90.

Further the lip seal 81, which may also be described as a packing, comprises a base region 91 in which an L-shaped reinforcement ring 92 is arranged which produces the required pretensioning so that the lip seal 81 pressed into the first short bore 77 remains fastened therein in an unmovable manner. The rotationally symmetric bearing surface 76 at the same time forms an axial stop.

An arcuate transition zone 93, proceeding from the end 79 of the skirting 71 radially in the direction to the axis 11, firstly faces away from the housing 14. When approaching the axis 11 the transition curving 93, describing a curve, runs increasingly in the direction of the housing 14 in order finally the blend into the second surface 87.

Figure 1C:
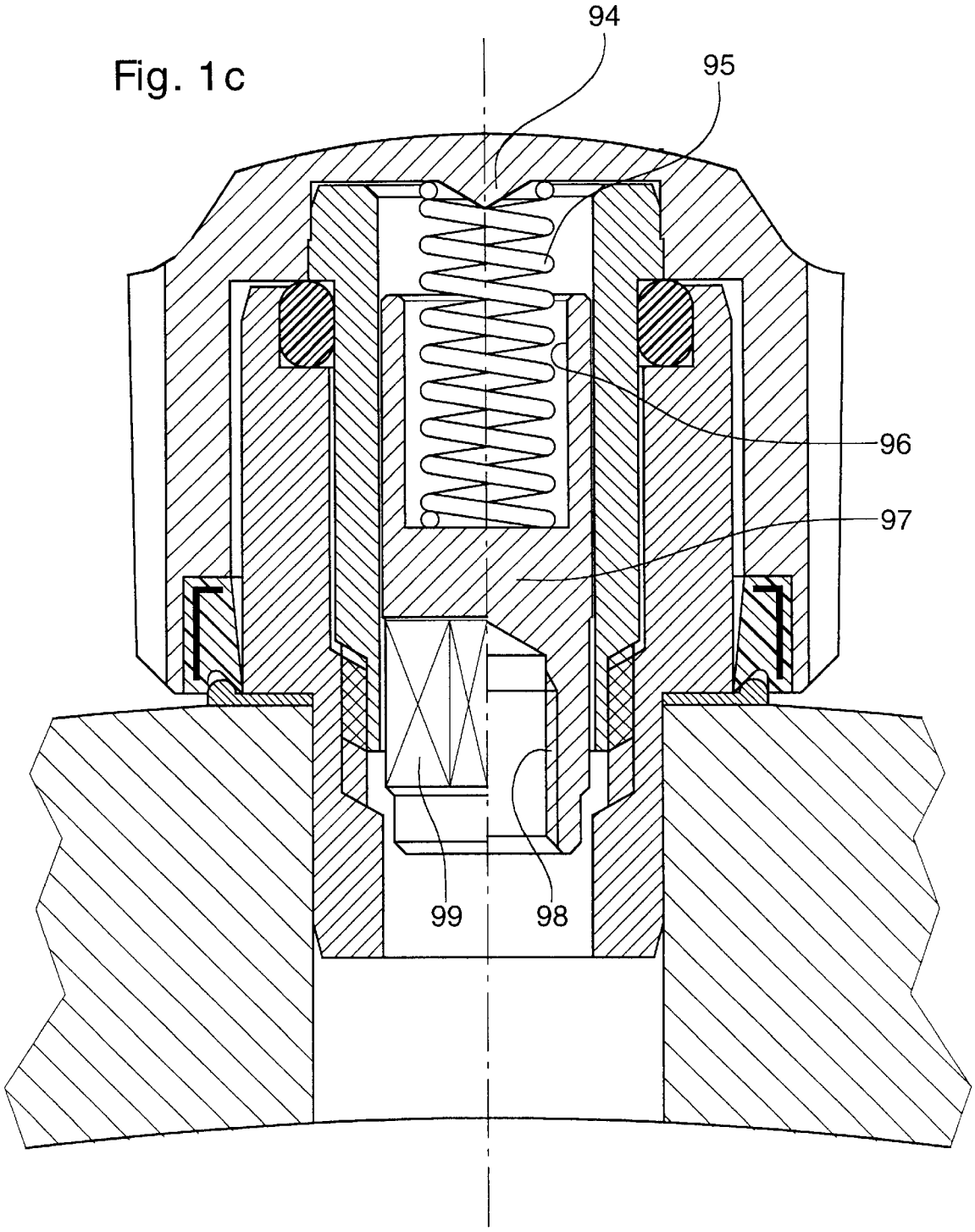

Further reference numerals are incorporated exclusively into FIG. 1*c* for the purpose of relieving FIGS. 1*a* and 1*b*.

On the inside in the head 69 of the cover 63 there is provided a projection 94 for centering a compression spiral spring 95. The compression spiral spring 95 leads into a pocket hole 96 of a pin 97. This pin 96 comprises on its side facing the housing 14 on the inside an inner thread 98 for accommodating a setting and winding-up shaft which is not shown and on the outside a hexagon insert bit 99 which in the FIGS. 1*a* to 1*c* is shown more clearly left of the axis. The hexagon insert bit 99 is in engagement with the hexagon socket 68 and connects the pin 97 with the small tube 62 in a rotationally rigid manner, but however permits relative movements in the direction of the axis.

In FIG. 1*a* the lid 63 shown in the unscrewed and pulled position, i.e. in the position removed from the housing 14. In this position of the crown the lip seal 81 fixed in the skirting 71 of the cover 63 in the upper region of the shank 56 of the sleeve 12 bears on the cylinder jacket shaped surface 58 whilst the O-ring 54 arranged in the slot 46 is located in the lower region of the surface 64 of the small tube 62. In this position of the lid 63 the pin 97 and thus the setting and winding-up shaft which is not shown are pulled out of the housing, since the upper end of the short hexagon socket 68 abuts on the upper end of the hexagon insert bit 99.

In the FIG. 1*b* the cover 63 is likewise shown in an unscrewed position, but is however located in the winding up position, i.e. in the position not pulled out. Also in this position of the crown the upper end of the short hexagon socket 68 abuts on the upper end of the hexagon insert bit 99, i.e. that the tube 62 and the pin 97 are located relative to one another in the same location as in FIG. 1*a*. The lip seal 81 and the O-ring 54 lie in FIG. 1*b* in the centre region of the surfaces 58 and 64 respectively.

In contrast in FIG. 1*c* the cover 63 is shown in the screwed down position. The outer thread 66 and the inner thread 38 are in engagement, wherein the shoulder 40 is in abutment with the end of the outer thread 66 which is not provided with a reference numeral, in order to define the end position of the screwed down lid 63. The pin 97 is located on the same position which is not shown, as in FIG. 1*b*. The upper end of the short hexagon socket 68 on the other hand no longer abuts on the upper end of the hexagon insert bit 99. The two hexagons 68 and 99 are however still in engagement and couple the pin 97 with the small tube 62 or with the cover 63 in a rotationally rigid manner. The lip seal 81 fixed in the skirting 71 in the lower region of the shank 56 of the sleeve 12 bears on the cylinder jacket shaped surface 58, whilst the O-ring 54 is located in the upper region of the surface 64 of the small tube 62. In this screwed down position of the lid 63 the contact surface 73 presses against the O-ring 54 and reinforces its sealing effect between the sleeve 12 and the small tube 62. The annular bulge 28 reaches into the lip seal 81, i.e. so presses on the surface 87 that the lip 82 is pressed more heavily on the surface 58 of the small tube 62 and by way of this seals better. At the same time the small relief 60 offers space for accommodating the pointed edge region 90 of the lip 82, so that this is not disadvantageously deformed. With a screwed down lip 63 the sealing effect of the operating means 100 according to the invention is thus increased twice, in that on the one hand the lip 82 is closed more strongly and on the other hand the O-ring 54 is compressed more strongly. It is however to be expressly mentioned that already the effect of the lip seal 81 alone is sufficient in order to satisfy the demands as for example occur on diving. The cover 63 may for example be screwed down before diving in order under extreme conditions to be able to ensure the highest safety against the penetration of water and dirt into the inner space 16 of the timepiece.

As has been mentioned the lip seal 81 with the suggested assembly orientation has the advantage that the bearing pressure of the skirt-shaped lip 82 which may for example run in an extremely pointed manner increases with an increasing pressure of the surroundings.

Reversely the lip 82 with an excess pressure in the timepiece is deformed in a manner such that it is pressed away from the surface 58 and permits an effective relieving of the inner space 16 of the timepiece.

By way of the fact that the lip seal 81 is the component lying closest to the surroundings and that it functions as a dirt stripper, particles of dirt cannot penetrate further in the direction of the inner space 16.

The angles 85 and 88 incorporated in FIG. 1*b* do not necessarily need to correspond to the selected 10° or 45°. The angle 85 of the wedge-shaped free space 84 is decisive for the opening behaviour of the lip seal with an inner excess pressure and must therefore as a rule be smaller than 90°. The angle 88 on the other hand is decisive for the closing and sealing behaviour of the lip seal with an outside excess pressure and must therefore as a rule likewise be smaller than 90°. Thus the lip itself has an angle which lies between 0° and 90°, wherein here it must be stated that the shape of this lip does not need to correspond to those of the FIGS. 1*a* to 1*c*. For example the two surfaces 83 and 87 could also run parallel to one another, instead of opening out into a pointed edge region 90. The edge region 90 likewise need not be formed pointed, but may relatively thick depending on the demands on the lip seal. The dirt deflecting function is however accomplished particularly well with an edge region 90 running out in a pointed manner. According to the FIGS. 1*a* to 1*c* the lip 82 bears on the surface 58 of the sleeve essentially only in the edge region 90 thereof. Of course the contact surface between the lip 82 and the surface 58 may also be considerably larger and assume the shape of a cylinder jacket.

According to the FIGS. 1*a*, 1*b* and 1*c* the lip seal 81 is fixed in the cover 63. As a rule however it is also possible to fix the base region 91 of the lip seal 81 in a groove provided outside in the sleeve 12, whilst the lip 82 bears conically led away from the axis 11 and bears internally in the cover 63. For this, proceeding from the FIGS. 1*a* to 1*c*, the cross section of the lip seal 81 would have to be mirrored on a vertical axis.

It is however advantageous to place the lip seal 81 acting as a dirt barrier or the surface zone 87 in contact with the surroundings, as is shown in the FIGS. 1*a* to 1*c*, i.e. to so arrange the transition between the surroundings 18 and the inner space 16 that where possible all components of the operating means are shielded and protected from the surroundings 18. Within this context the gap lying between the surfaces 58 and 74 according to FIGS. 1*a* to 1*c* no longer belongs to the surroundings 18 since it is shielded from this by way of the lip seal 81. Dirt particles according to this embodiment form of the invention do not even get access to gaps, notches and the various components such as O-rings, threads, etc.

Further it is of course also possible to put forward a solution in which the lip 82 does not point towards to housing 14 as in FIGS. 1*a* to 1*c* but is arranged pointing away from the housing 14. For this, proceeding from these figures the cross section of the lip seal 81 would thus have to be mirrored on a horizontal axis. Such an arrangement would be useful when the lip seal 81 is provided at a location at which the O-ring 54 is located in the FIGS. 1*a* to 1*c*. As long as in the groove 80 of the lid 63 no further seal is provided the surroundings 18 in such a case reaches up to in the intermediate space 86.

As a rule the arrangement of the lip seal is possible at various locations of the operating means according to the invention, but its orientation is of a decisive importance. As has already been stated several times the elastic lip is to be directed such that it closes when the outer pressure is greater than the pressure in the inside of the timepiece, and that it opens when an inner excess pressure is present. For this an extremely slight deformation of the lip is generally already sufficient.

Of course there may also be provided several lip seals placed behind one another with regard to their effect.

As mentioned the operating means according to the invention may be provided in the form of a screwed down or unscrewed crown, a push-piece, a switch a correcter or likewise. That which has been mentioned previously in the context of the crown 10 applies equally for other operating means since the advantages of a lip seal are of course not specific to a crown. Since for example a push-piece or pressing dial is formed differently from a crown according to each case a lip seal must be provided which is different from those in FIGS. 1*a* to 1*c*, i.e. which for example, as mentioned above is arranged pointing away from the housing. For a correction it may be useful to attach the lip seal to the plunger in a stationary manner, whilst the lip faces outwardly bearing on the bore walling of the sleeve.

Whichever way the lip seal is formed and arranged depending on the type of operating element is a question of optimization for the individual case. However its alignment is decisive, i.e. the alignment of the elastic lip so that on the one hand with an inner excess pressure there may be effected a pressure compensation between the inner space and the surroundings and on the other side with an excess pressure of the surroundings the inner space may be shielded from the surroundings.

What is claimed is:

1. An operating means for a timepiece, which comprises an element rigid with the housing, an operable element movable with respect to this element as well as a seal arranged between the two elements, which delimits the timepiece inner space from the surroundings, wherein:

the seal is a lip seal which comprises a base region as well as a rotationally symmetric lip, the base region is arranged in a stationary manner in a first of these elements, the lip bears on a cylinder jacket shaped surface region of a second of these elements and the lip, proceeding from the base region and facing in the direction of the surroundings, is led conically onto the cylinder jacket shaped surface region and bears on this with pretensioning, the lip comprises two rotationally symmetric surface zones, of which a first of these surface zones faces the timepiece inner space and the second of these surface zones is in contact with the surroundings, the first surface zone essentially, proceeding from the base region and facing in the direction of the surroundings, leads conically to the cylinder jacket shaped surface region, that between the first surface zone and the cylinder jacket shaped surface region there is provided a rotationally symmetric free space which in cross section is formed essentially wedge-shaped and is delimited from the surroundings by the lip, and that the second surface zone essentially proceeding from the base region and facing in the direction of the surroundings, leads conically to the cylinder jacket shaped surface region, in order on the one hand to release itself rom the surface region for the purpose of pressure compensation between the inner space and the surroundings given an inner space excess pressure and in order on the other hand to be more strongly pressed on the surface region for the purpose of sealing the inner space with respect to the surroundings given an excess pressure of the surroundings.

2. An operating means according to claim 1, wherein the two surface zones approach in the direction towards the cylinder jacket shaped surface region and open into an essentially pointedly formed lip edge.

3. An operating means according to claim 2, wherein the second surface zone at the base region blends into a curving.

4. An operating means according to claim 1, wherein in the base region of the lip seal there is provided a reinforcement element.

5. An operating means according to claim 4, wherein the reinforcement element is a metal ring completely enclosed by the lip seal.

6. An operating means according to claim 1, wherein the base region is arranged in a stationary manner in the movable element and the cylinder jacket shaped surface region is provided on the outer side on the element rigid with the housing.

7. An operating means according to claim 1, wherein the base region is arranged in a stationary manner in the element rigid with the housing and the cylinder jacket shaped surface region is provided on the inner side on the movable element.

8. An operating means according to claim 1, wherein the operating means is a crown.

9. An operating means according to claim 8, wherein the operating means is a screwable crown.

10. An operating means according to claim 9, wherein the movable element is a crown cover and the element rigid with the housing is a sleeve which is provided for fastening in a timepiece housing and is at least partly surrounded by the crown cover.

11. An operating means according to claim 1, wherein the operating means is a push-piece.

12. An operating means according to claim 1, wherein the operating means is a correcter.

13. An operating means according to claim 1, wherein the operating means comprises a further seal.

14. An operating means according to claim 13, wherein the further seal is arranged on the inner space side of the lip seal and between it and the lip seal, or between the surroundings and the inner space there forms an intermediate space.

15. An operating means according to claim 14, wherein the further seal is an O-ring.

16. A timepiece with an operating means according to claim 1.

* * * * *